US006458425B2

(12) United States Patent
Ferrero et al.

(10) Patent No.: US 6,458,425 B2
(45) Date of Patent: Oct. 1, 2002

(54) ZINC ALLOYS YIELDING ANTICORROSIVE COATINGS ON FERROUS MATERIALS

(75) Inventors: Manuel B. Ferrero, Barcelona (ES); Pedro M. Tierra Royo, Barcelona (ES); Jeaninne Billiet, Ronse (BE); Wilhelmus J. A. M. Sprang, XG Maarasen (NL)

(73) Assignees: Floridienne Chimine S.A., Ath (BE); Otto Junker GmbH, Simmerath (DE); NetCoat Group B. V., Anblasserdam (NL); Industrial Galvanizadora S.A., Barcelona (ES); Siegener Verzinkerei Holding GmbH, Siegen (DE)

( * ) Notice: Subject to any disclaimer, the term of this patent is extended or adjusted under 35 U.S.C. 154(b) by 0 days.

(21) Appl. No.: 09/341,069

(22) PCT Filed: Dec. 23, 1997

(86) PCT No.: PCT/EP97/07296

§ 371 (c)(1),
(2), (4) Date: Sep. 3, 1999

(87) PCT Pub. No.: WO98/29576

PCT Pub. Date: Jul. 9, 1998

(30) Foreign Application Priority Data

Jan. 2, 1997 (EP) ..... 97100008

(51) Int. Cl.[7] ..... B05D 1/18; C22C 18/00

(52) U.S. Cl. ..... 427/433; 427/436; 106/1.17; 420/513; 420/520

(58) Field of Search ..... 427/433, 436; 106/1.17; 420/513, 520

(56) References Cited

U.S. PATENT DOCUMENTS 3,630,792 A * 12/1971 Smyth et al. ..... 148/6.3
3,740,214 A 6/1973 Pelzel ..... 75/178
4,812,371 A * 3/1989 Shindou et al. ..... 428/659
5,695,822 A * 12/1997 Carey, II et al. ..... 427/329

FOREIGN PATENT DOCUMENTS

| | | | | |
|---|---|---|---|---|
| BE | 882256 | * | 7/1980 | |
| JP | 55050484 | | 4/1980 | ..... C25D/3/22 |
| JP | 05044006 | * | 2/1993 | |
| JP | 05271892 | | 10/1993 | ..... C23C/2/06 |
| JP | 06065760 | | 3/1994 | ..... C23C/28/00 |
| JP | 06228789 | | 8/1994 | ..... C25D/5/26 |
| WO | WO 98/55664 | * | 12/1998 | |

OTHER PUBLICATIONS

Morgan, S.W.K., *Zinc and its alloys and compounds*; Corrosion Protection by Zinc; 1985; Ellis Horwood Limited, United Kingdom; pp. 192–195.

* cited by examiner

*Primary Examiner*—Michael Barr
(74) *Attorney, Agent, or Firm*—Sheridan Ross P.C.

(57) ABSTRACT

The present invention relates to a Zinc alloy yielding anticorrosive coatings on ferrous materials; characterized as consisting of zinc plus its usual impurities and possibly aluminum and/or lead as well as alloying metals consisting of between x and y% by weight of nickel together with between v and w% by weight of at least one of the metal: vanadium and chrome wherein:

x is equal to or higher than 0.001% by weight, preferably higher than 0.04% by weight, y is lower than or equal to 0.6% by weight, preferably lower than 0.2% by weight, v is equal to or higher than 0.001% by weight, preferably higher than 0.03% by weight, w is lower than or equal to 0.6% by weight, preferably lower than 0.04% by weight.

11 Claims, 1 Drawing Sheet

ZINC ALLOYS YIELDING ANTICORROSIVE COATINGS ON FERROUS MATERIALS

FIELD OF THE INVENTION

The present invention is related to zinc alloys yielding anticorrosive coatings on ferrous materials, consisting of zinc, plus its usual impurities and possibly aluminium or lead together with alloying metals: nickel as well as vanadium and/or chrome.

BACKGROUND OF THE INVENTION

Corrosion is a frequent but undesirable process in certain metals. To avoid corrosion the metals are usually coated with a layer of zinc.

There are different methods known and used to coat steel and other metals with zinc and zinc alloys, such as: hot dip galvanising, zinc spraying, etc. One of the oldest methods still in use for economical and technical reasons is the so-called hot dip galvanising process.

Hot dip galvanising basically consists of the immersion, for a few minutes, of ferrous materials in a molten zinc bath at a temperature of between 430 and 560° C.

Hot dip immersion produces a physicochemical mechanism by which a diffusion process takes place between the base iron of the parts and the zinc.

The zinc coating gives the necessary good corrosion resistance to ferrous metals.

In general, a zinc coating obtained by hot dip galvanising consists of several layers: an internal alloy of iron and zinc which adheres to the surface of the ferrous material, and an external layer, consisting almost entirely of pure zinc, according to the composition of the bath, called the Eta phase. In the interior layer, formed by the diffusion of zinc into the ferrous material, up to three zones or sub-layers can be distinguished, identified by their different iron contents. The sub-layer closest to the base material is called the Gamma phase and contains 21 to 28% iron. Next is the Delta phase, which contains from 6% to 11% iron, and finally the Zeta phase which contains approximately 6% iron.

Depending on the composition of the ferrous material of the part to be coated, the Zeta phase varies greatly in thickness and often tends to pass through to the external layer consisting mainly of pure zinc.

When e.g. construction grade steel is galvanized in a conventional zinc bath, without additional alloying metals, a galvanised coating with a relatively thin Delta phase and a Zeta layer are produced. The Zeta layer consists of large column crystals and reaches out to very near to the surface of the coating, while the Eta layer of pure zinc is almost non-existent.

The resulting coating layer has very low adherence because of the thick iron rich Zeta phase.

PRIOR ART

PATENT ABSTRACTS OF JAPAN, vol. 096, no. 007, Jul. 13, 1996 & JP 08 060329 A (KOBE STEEL LTD) concerns the production of galvannealed steel sheet in a continuous hot-dip process wherein the zinc coating bath contains Al, as well as Ni, Co and/or Ti.

PATENT ABSTRACTS OF JAPAN, vol. 018, no. 052 (C-1158), Jan. 27, 1994 & JP 05 271892 A (NISSHIN STEEL CO. LTD) , describes a method for controlling galvanising bath. The aim of this invention is to reduce the influence of aluminium on the zinc bath in continuous hot-dip galvanising of steel sheet by the Ni addition. The coating bath contains Zn, Al and Ni.

PATENT ABSTRACTS OF JAPAN, vol. 017, no. 345 (C-1077), Jun. 30, 1993 & JP 05 044006 A (NIPPON STEEL CORP) is related to the production of alloyed hot-dip galvanising steel sheet having excellent workability and corrosion resistance. The galvanising bath contains Al and V.

PATENT ABSTRACTS OF JAPAN, vol. 017, no. 678 (C-1141), Dec. 13, 1993 & JP 05 222502 A (KAWASAKI STEEL CORP) concerns Zn—Cr—Al series hot-dip galvanised steel excellent in corrosion and peeling resistance and its manufacture. The goal of this invention is to obtain hot-dip galvanised steel using Zn—Cr—Al alloy with an excellent corrosion and peeling off resistance. On the surface of the steel to be galvanized is previously deposited a substance containing phosphorous.

PATENT ABSTRACTS OF JAPAN, vol. 016, no. 168 (C-0932) , Apr. 22, 1992 & JP 04 013856 A (NIPPON STEEL CORP), describes the production of galvannealed steel sheet having a superior corrosion resistance in a continuous hot-dip. The galvanising bath consists in a Zn—Al—Cr alloy and includes a subsequent heat treatment at about 510° C.

PATENT ABSTRACTS OF JAPAN, vol. 018, no. 114 (C-1171) , Feb. 24, 1994 & JP 05 306445 A (NIPPON STEEL CORP) is related to the manufacture of P-containing high strength galvannealed steel sheet. The phosphorous content is 0.01–0.2% and the composition of the bath is zinc, aluminium and one or-two of the following elements: Mn, Mg, Ca, Ti, V, Cr, Co and Ce.

The document GB 1 493 224 A (ITALSIDER SPA) concerns a zinc-based alloy of continuous coating of wire and steel sheet using the Sendzimir technique. The coating bath consists in Zn, Al, Mg, Cr, Ti.

The document EP 0 042 636 A (CENTRE RECHERCHE METALLURGIQUE) is about a process characterized by the use of a coating bath containing zinc with the addition of one or two of the following elements: Al, Be, Ce, Cr, La, Mg, Mn, Pb, Sb, Si, Sn, Ta, Ti, Te and Th to obtain over the first coating a supplementary protection layer formed by stable compounds.

None of these documents suggest the use of nickel together with vanadium and/or chrome as alloying metals for zinc.

SUMMARY OF THE INVENTION

The aims of the invention are to provide improved zinc base alloys used to coat parts made of ferrous material having a superior corrosion resistance.

Surprisingly, it was found that these aims could be achieved by means of specific alloying metals, more particularly by means of zinc alloy yielding anti-corrosive coatings on ferrous materials characterized as consisting of zinc plus its usual impurities and possibly aluminium and/or lead as well as alloying metals consisting of between x and y% of nickel together with between v and w% of at least one of the metals: vanadium and chrome wherein:

- x is equal to or higher than 0.001, preferably higher than 0.04,
- y is lower than or equal to 0.6, preferably lower than 0.2,
- v is equal to or higher than 0.001, preferably higher than 0.03,
- w is lower than or equal to 0.6, preferably lower than 0.04.

All the indicated percentages are expressed as % w/w throughout the specification and claims.

Without being bound by the explanations given, Applicants have observed that the use of these alloys produces a much thinner Zeta layer, resulting in an improvement of its mechanical resistance, and a relatively much thicker Eta layer, resulting in an important increase in the corrosion resistance of the coating. Vanadium giving generally better results than chrome is also usually preferred.

Figure 1:
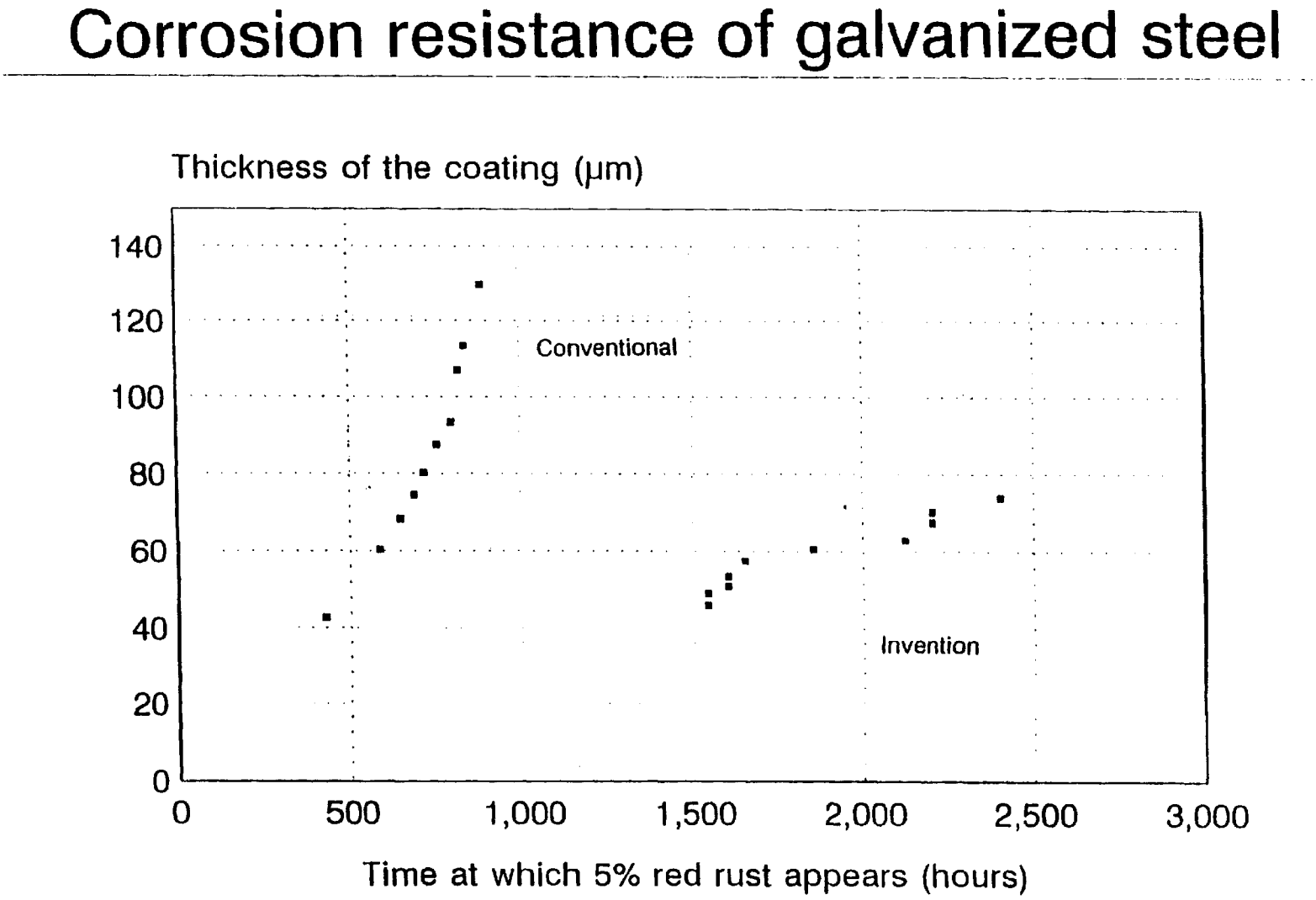
FIG. 1 is a graph illustrating test results for samples of material galvanized conventionally, and samples galvanized using a composition in accordance with the present invention.

Preferably, the zinc content of the alloy is at least 90% and more preferably at least 95% and the aluminium content is equal to or lower than 0.25%, and more preferably between 0.001 and 0.25%, while the lead content is between 0 and 2% and more usually below 1.2%.

The most frequent "impurity" in zinc bath is iron and iron may thus be present in quantities up to the solubility limit of Fe in zinc bath at the different operation temperatures.

When the ferrous material is galvanized in a zinc alloy according to the invention, the coating structure is very different from that obtained when galvanized without said alloying metals. The Delta phase is very similar in appearance, but the Zeta layer, normally consisting of large column crystals, has been transformed into a relatively thin layer of crystals as a result of the inhibiting (levelling) action of the alloying metals, nickel, vanadium, and/or chrome. A thick layer of zinc also appears (Eta phase) which, otherwise, is much thinner when galvanising without said alloying metals. The new galvanised structure, with a relatively thin Delta and Zeta layers, increases the ductility and adherence of the coating, as well as the corrosion resistance due to the relatively greater thickness of the external layer of zinc.

The alloys according to the invention may be used with different types of steel, especially those having a high content of Si and/or P and/or Al, as they reduce the reactivity thereof, in addition to enhancing corrosion resistance.

The galvanising of ferrous material using the alloys of the invention are typically performed by batch hot-dip galvanising processes, although the use of a continuous hot-dip galvanizing process is also contemplated.

EXAMPLES

Series of tests were conducted on steel sheets whose dimensions are: 200×100×3.5 mm, with the following coatings:

Hot-dip galvanized samples in a bath which composition was: 0.005% Al, 0.150% Ni, 0.045w% V and the balance Zn. Samples are named "A-1" o "A-10". The working method and galvanizing tests characteristics are given hereafter and in Table I.

Hot-dip galvanized samples in a bath with the following composition: 0.004% Al and the balance Zn. These samples are nominated as: "B-1" to "B-10". Working method and galvanizing tests characteristics are given hereafter and in Table II.

All corrosion tests were conducted according to ASTM-B-117-90.

The results of Table I and Table II are shown in FIG. 1.

Working Method

| | |
|---|---|
| 1. Degreasing | 6% aqueous solution Galva Zn-961 during 20 min. |
| 2. Pickling | 50% Hydrochloric acid, until total clean. |
| 3. Rinsing | In water (pH = 7) |
| 4. Fluxing | 1 min. at 80° C. |
| 5. Drying | Electric oven: 5 min. at 120° C. |
| 6. Galvanizing | See Tables. For all tests Immersion/Extraction V in/out = 2/2 m/min. |
| 7. Cooling | In the air |

Steel Composition 0,075%C, 0,320%Mn, 0,020%Si, 0,012%S, 0,013%P, 0,040%AL, 0,020%Cr, 0,020%Ni, 0,035%Cu The microstructure of the coatings was examined under optical microscopy, using clear field and polarised light techniques on samples etched with nital at 2% (nitric acid at 2% in ethanol) and under scanning electron microscope (SEM) on polished sections. The distribution and analyses of the elements was determined by X ray spectrometry (EDS) and glow discharge optical spectroscope (GDOS). With the two techniques, EDS and GDOS, it was possible to observe that the alloying metals nickel and vanadium are sited mainly between the Delta and Zeta phases of the coating, restricting the growth of both intermetallic phases. This results in a more homogeneous coating with a thinner intermetallic layer, which provides great adherence and ductility, increasing the mechanical resistance of the coating. It also produces an external zinc layer which is thicker and more compact, thus greatly improving corrosion resistance.

To estimate the adherence of the coating, which reflects its mechanical resistance, the ASTM A- 123 standard hammer test was used. The results of these tests show the strong adherence of the coatings obtained using the inventions. The coating did not fracture between the two hammer blows, while the zinc coating without alloying metals fractured under the same conditions.

To compare the corrosion resistance of conventional galvanised coatings with those obtained using the protocols of the invention, accelerated corrosion tests were undertaken. The results are to be found in FIG. 1.

The graph shows the initial coating thickness required to resist corrosion in a salt-spray chamber, in accordance with the ASTM B-1 17-90 standard, for the time shown along the X-axis.

The results on the left-hand (which represents substantially a parabolic curve) are the resistance values of a galvanised zinc product without alloy to be found in Table II. The results on the right-hand (which represents substantially a straight line) are the values given by a galvanised product using the alloy shown in Table I.

The graph shows that for the minimum thickness accepted as an industrial standard, 40 $\mu$m, the conventionally galvanised product resists for 400 hours, while the galvanised product with alloys, subject to the invention, resists corrosion for over 1300 hours. 70 $\mu$m of conventional galvanised product resists for some 600 hours, while a product coated in accordance with the invention resists corrosion for more than 2300 hours. With conventional galvanising, increasing the coating to a thickness of over 140 $\mu$m does not improve resistance to more than 900 hours, while galvanising with the alloy subject to the invention would make it possible to obtain corrosion resistance of over 2400 hours, with an increased thickness of slightly more than 70 $\mu$m.

With a minimum thickness of 40 $\mu$m, the invention offers a level of corrosion resistance which would need a thickness of much more than 160 μm if conventionally galvanised. This clearly shows that the invention not only improves the mechanical and, corrosion resistances spectacularly, but also allows a saving in the consumption of zinc of more than 75%.

Further comparisons of a composition according to the invention and the other compositions have been conducted under operation conditions as mentioned below:

| | |
|---|---|
| 1. Degreasing | Cetenal 70 and 9590 |
| 2. Rinsing | in water (pH = 7) |
| 3. Pickling | until clean |
| 4. Rinsing | if water (pH 7) |
| 5. Fluxing | 1 minute, G105 200 g/l |
| | T = cold |
| 6. Drying | Above the bath until dry |
| 7. Galvanizing | T = 440 ° C., $t_{im}$ = varies |

$v_{in/out}$=10/10 m/min

The other operation conditions and results are mentioned in Table III hereafter.

Having described in detail the nature of the invention, and having given practical examples of its use, it should be noted that modifications may be made thereto, as long as such do not represent a substantial change to the characteristics claimed below.

TABLE I (Invention)

| Example Nos. | Temperature (° C.) | T immersion (sec) | Thickness of the coating (μm) | Hours until appearance of 5% red rust |
|---|---|---|---|---|
| A1 | 442 | 120 | 42.8 | 1540 |
| A2 | 440 | 140 | 60.3 | 1540 |
| A3 | 439 | 160 | 68.3 | 1600 |
| A4 | 440 | 200 | 74.4 | 1600 |
| A5 | 439 | 260 | 80.2 | 1650 |
| A6 | 440 | 400 | 87.5 | 1850 |
| A7 | 441 | 500 | 93.4 | 2120 |
| AB | 439 | 600 | 106.9 | 2200 |
| A9 | 440 | 800 | 113.4 | 2100 |
| A10 | 440 | 1000 | 129.6 | 2400 |

TABLE II (Conventional)

| Example Nos. | Temperature (° C.) | T immersion (sec) | Thickness of the coating (μm) | Hours until appearance of 5% red rust |
|---|---|---|---|---|
| B1 | 441 | 30 | 42.8 | 430 |
| B2 | 441 | 60 | 60.3 | 590 |
| B3 | 440 | 90 | 68.3 | 650 |
| B4 | 441 | 120 | 74.4 | 690 |
| B5 | 440 | 150 | 80.2 | 720 |
| B6 | 441 | 180 | 87.5 | 760 |
| B7 | 439 | 240 | 93.4 | 800 |
| B8 | 441 | 300 | 106.9 | 820 |
| B9 | 440 | 480 | 113.4 | 840 |
| B10 | 442 | 600 | 129.6 | 890 |

TABLE III

| Sample number | coating thickness [μm] | Temperature [° C.] | Composition of the Zinc bath [% w/w] Ni | V | Pb | Al | Fe | Number of hours before 5% red rust occurs [hours] |
|---|---|---|---|---|---|---|---|---|
| 1 | 61 | 440 | 0.190 | 0.000 | 0.070 | 0.002 | 0.008 | 450 |
| 2 | 61 | 440 | 0.183 | 0.040 | 0.052 | 0.006 | 0.009 | 1150 |

What is claimed is:

1. Zinc alloy intended for anti-corrosive coatings on ferrous materials, comprising 0.001–0.6% by weight nickel, 0.001–0.6% by weight vanadium, at least 90% by weight zinc, the balance being usual impurities.

2. Zinc alloy according to claim 1, wherein the vanadium content is 0.001–0.4% by weight.

3. Zinc alloy according to claim 1, wherein the vanadium content is 0.001–0.2% by weight.

4. Zinc alloy, according to claim 1, wherein the nickel content is 0.04–0.2% by weight.

5. Zinc alloy according to claim 1, wherein the vanadium content is 0.03–0.04% by weight.

6. Zinc alloy according to claim 1, wherein the zinc content is at least 95% by weight.

7. Zinc alloy according to claim 1, further comprising aluminium, wherein the aluminium content is 0.001–0.25% by weight.

8. Zinc alloy according to claim 1, further comprising lead, wherein the lead content is 0–2% by weight.

9. Zinc alloy according to claim 1, further comprising lead, wherein the lead content is 0–1.2% b y weight.

10. Process for yielding anti-corrosive coatings on ferrous materials where the alloy of claim 1, is applied in a batch hot-dip galvanizing process.

11. Process for yielding anti-corrosive coatings on ferrous materials where the alloy of claim 1, is applied in a continuous hot-dip galvanizing process.

* * * * *